US005447298A

United States Patent [19]

Watanabe et al.

[11] Patent Number: 5,447,298

[45] Date of Patent: Sep. 5, 1995

[54] MOVABLE FINISHER DEVICE WITH MULTIPLE STACK GRIPPING FINGERS

[75] Inventors: Tetsuji Watanabe; Nobuyoshi Seki; Yuichi Fujii; Masatoshi Hosoi; Mitsuru Ichikawa; Yuji Ueno, all of Nagoya; Yoshiaki Ushirogata, Tokyo, all of Japan

[73] Assignee: Ricoh Company, Ltd., Tokyo, Japan

[21] Appl. No.: 140,540

[22] Filed: Oct. 25, 1993

[30] Foreign Application Priority Data

Oct. 27, 1992 [JP] Japan ..... 4-288847
Oct. 30, 1992 [JP] Japan ..... 4-293137
Jun. 16, 1993 [JP] Japan ..... 5-145150

[51] Int. Cl.[6] ..... B42B 2/02; B31B 1/70
[52] U.S. Cl. ..... 270/53
[58] Field of Search ..... 270/53; 355/324

[56] References Cited

U.S. PATENT DOCUMENTS 5,080,342 1/1992 Mori et al. ..... 270/53
5,330,170 7/1994 Uotani et al. ..... 270/53

FOREIGN PATENT DOCUMENTS 4-257492 9/1992 Japan ..... 270/53

*Primary Examiner*—John E. Ryznic
*Attorney, Agent, or Firm*—Oblon, Spivak, McClelland, Maier & Neustadt

[57] ABSTRACT

A finisher for binding paper sheets sequentially driven out of an image forming apparatus. A finisher moves along an edge of a stack of sheets and curves around a corner. A pair of individualy operated gripper fingers grabs the stack of sheets and moves the stack into position for finishing.

5 Claims, 11 Drawing Sheets

MOVABLE FINISHER DEVICE WITH MULTIPLE STACK GRIPPING FINGERS

BACKGROUND OF THE INVENTION

The present invention relates to a finisher for a copier, printer or similar image forming apparatus and, more particularly, to a finisher operatively connected to the paper outlet of the image forming apparatus for binding papers sequentially driven thereoutof.

A finisher for the above application is often implemented with a binder capable of binding papers sequentially distributed from an image forming apparatus to bins and positioned on the bins in neat stacks. This type of finisher has a chuck for chucking a paper stack with a pair of chucking members and then bringing it to the binder. The binder has a binding mechanism arranged perpendicularly to an intended direction of paper discharge. Hence, the chuck is so constructed as to move the paper stack to the binder perpendicularly to the direction of paper discharge. At this instant, the paper stack is prevented from rotating due to gravity in the direction of paper discharge, since it is moved along the rear edge of the bin. To cause the binder to perform both of rotation and parallel movement, the finisher may be provided with two drive sections respectively assigned to a rotation section and a parallel movement section, or may be provided with a drive source on a movable portion thereof. To stop the movable portion :at particular positions, use may be made of sensors.

However, the conventional finished has some problems left unsolved, as follows. When the chuck chucks a paper stack and moves it in the direction parallel to the intended direction of paper discharge, a guide provided at the rear edge of the bin has to be retracted. Then, a support bearing the force ascribable to the weight of the paper stack is lost. In this condition, it is likely that the paper stack held by the chuck is rotated about the chucked portion thereof due to gravity and, therefore, bound defectively. When independent drive sources are respectively assigned to the rotation section and the parallel movement section, as mentioned above, complicated control over the drive sources is necessary for the two kinds of motions to be interlocked. In addition, such drive sources result in a complicated mechanism and an expensive finisher. On the other hand, when a drive source is mounted on a movable portion, as also mentioned above, the movable portion becomes bulky and needs a great space for movement. Further, such a bulky movable portion cannot move at high speed.

SUMMARY OF THE INVENTION

It is, therefore, an object of the present invention to provide a finisher for an image forming apparatus which, when a paper stack is moved in parallel to an intended direction of paper discharge, prevents it from being rotated due to gravity without resorting to a guide heretofore provided at the rear edge of a bin, thereby insuring stable and accurate binding.

It is another object of the present invention to provide a finisher for an image forming apparatus which has a simple and inexpensive binder.

In accordance with the present invention, a finisher for an image forming apparatus comprises a distributing device for distributing papers sequentially driven out of the image forming apparatus, a positioning device for positioning the papers distributed, a binding device for binding the papers distributed and positioned in a stack, and a chucking device comprising two pairs of chucking members which are spaced a predetermined distance from each other in an intended direction of paper discharge. The chucking device chucks the stack of papers and moves it to the binding device.

Further, in accordance with the present invention, a finisher for an image forming apparatus comprises a distributing device for distributing papers sequentially driven out of the image forming apparatus to a plurality of bins, a positioning device for positioning the papers distributed to the plurality of bins, and a binding device movable along and in parallel to a rear edge of any one of the plurality of bins, and rotatable at a front side of the bin contiguous with the rear edge.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
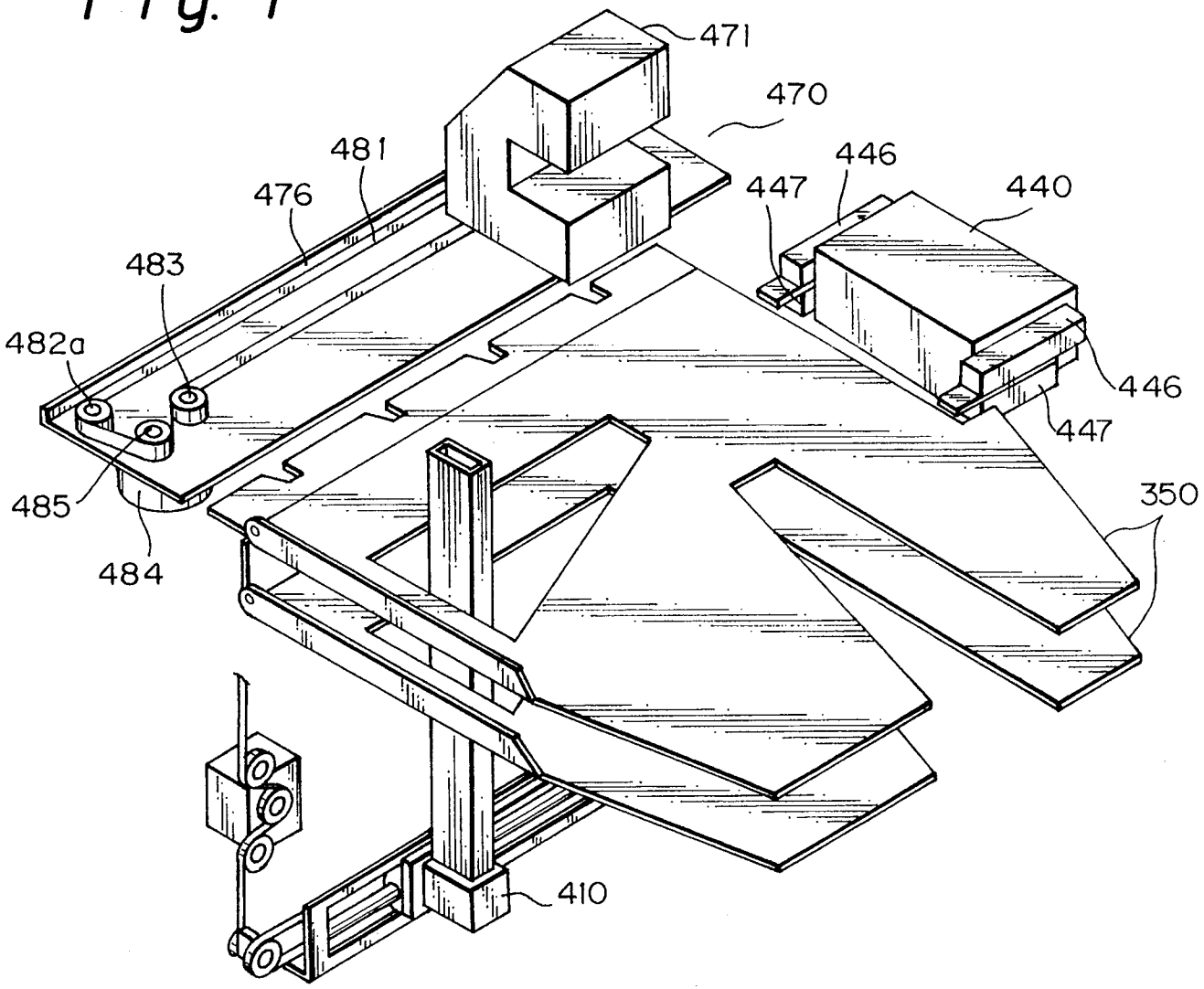
FIG. 1 is a perspective view showing a first and a second embodiment of the finisher in accordance with the present invention.
Figure 2:
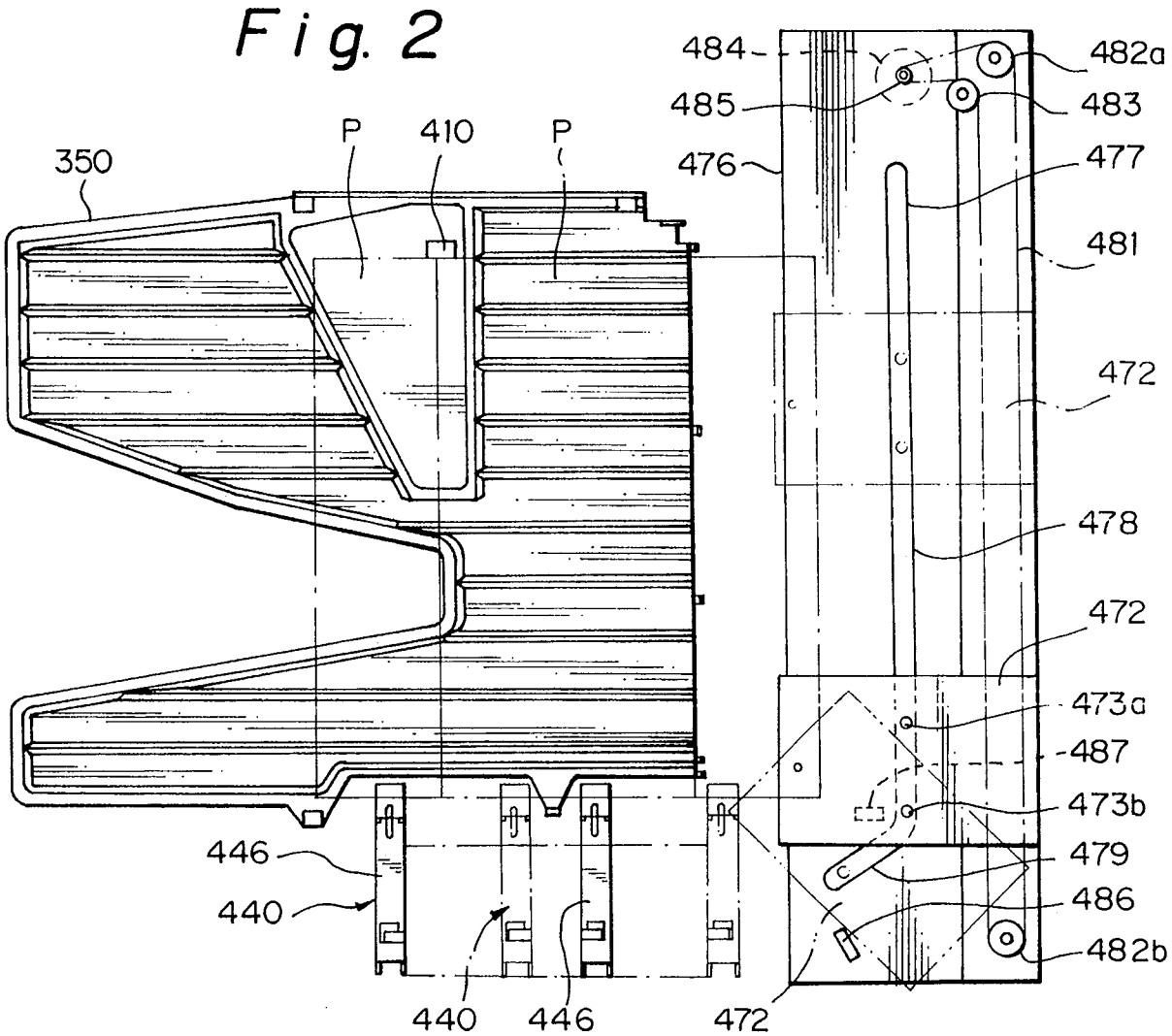
FIG. 2 is a plan view of the first embodiment of the present invention.
Figure 3:
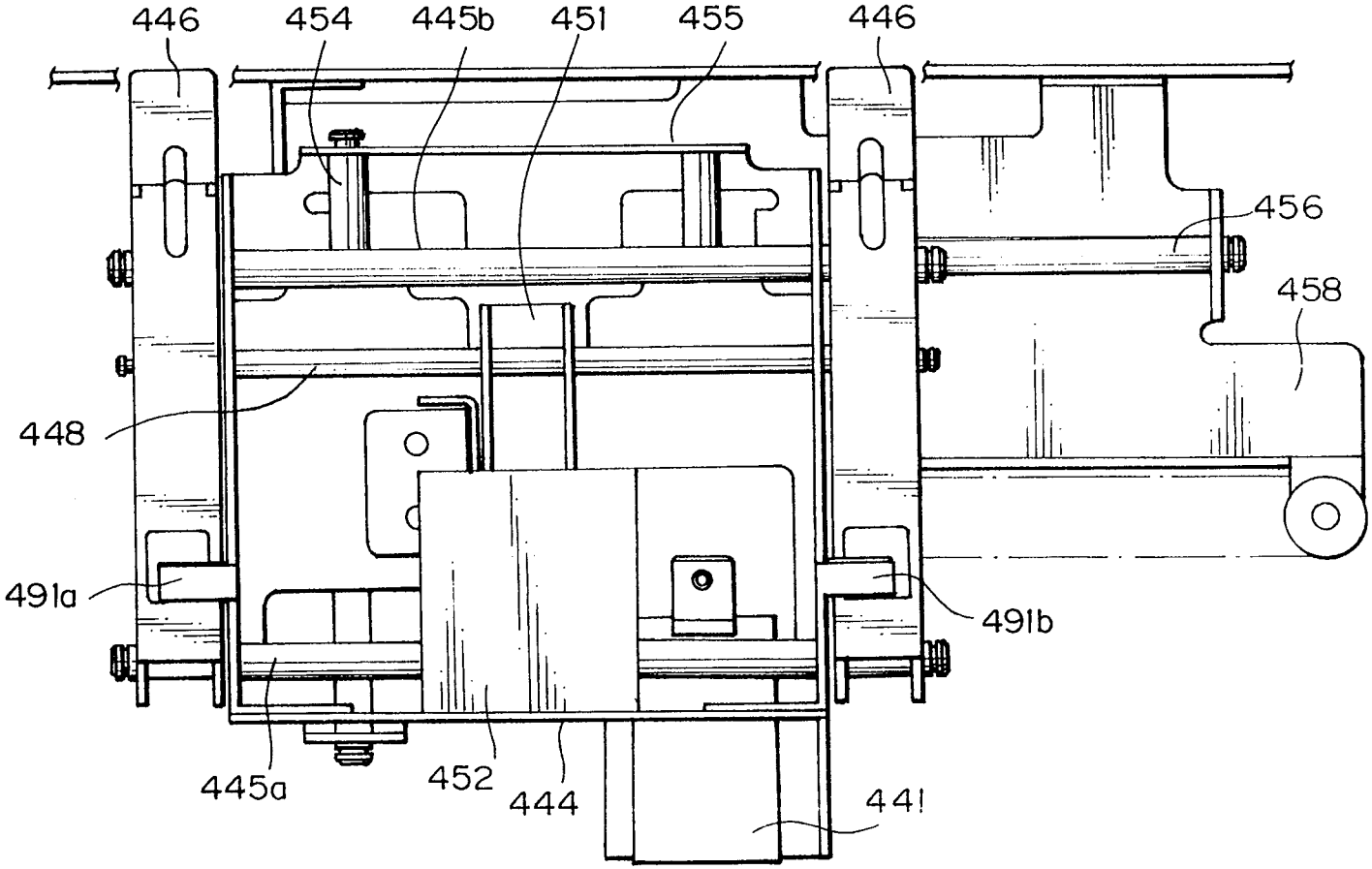
FIG. 3 is a plan view of the first embodiment.
Figure 4:
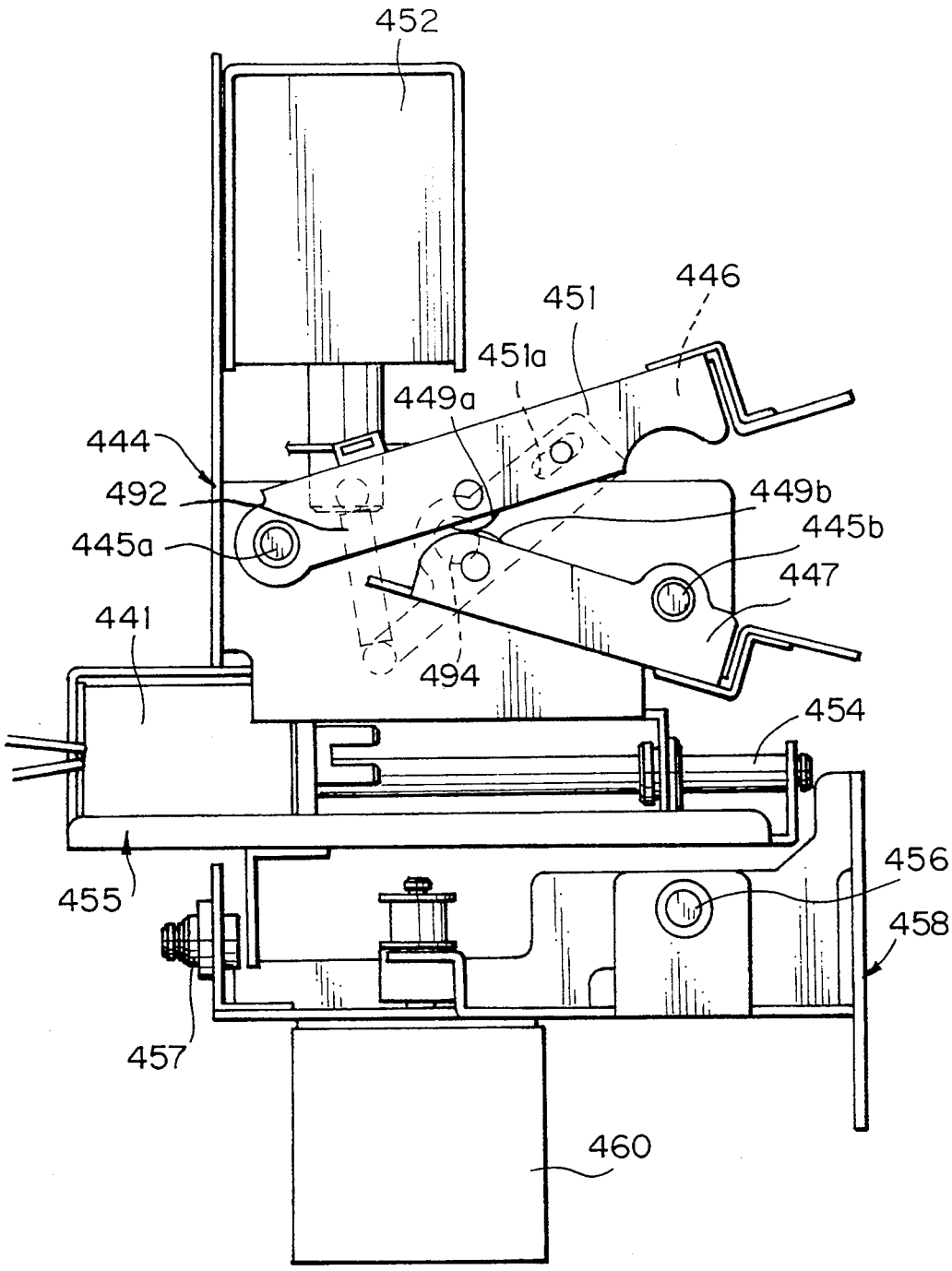
FIG. 4 is a side elevation of a chuck included in the first embodiment.
Figure 7:
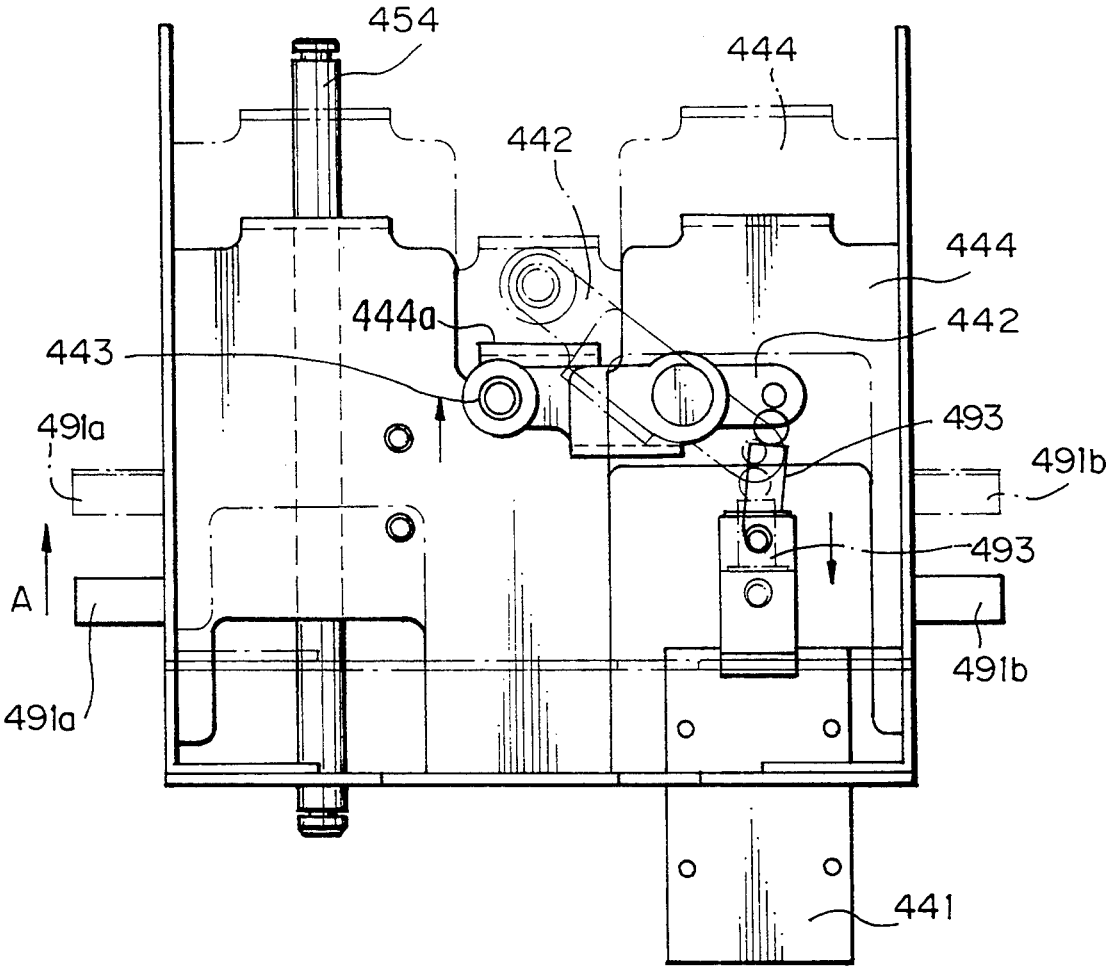
FIG. 7 is representative of the front-and-rear movement of the chuck.
Figure 8:
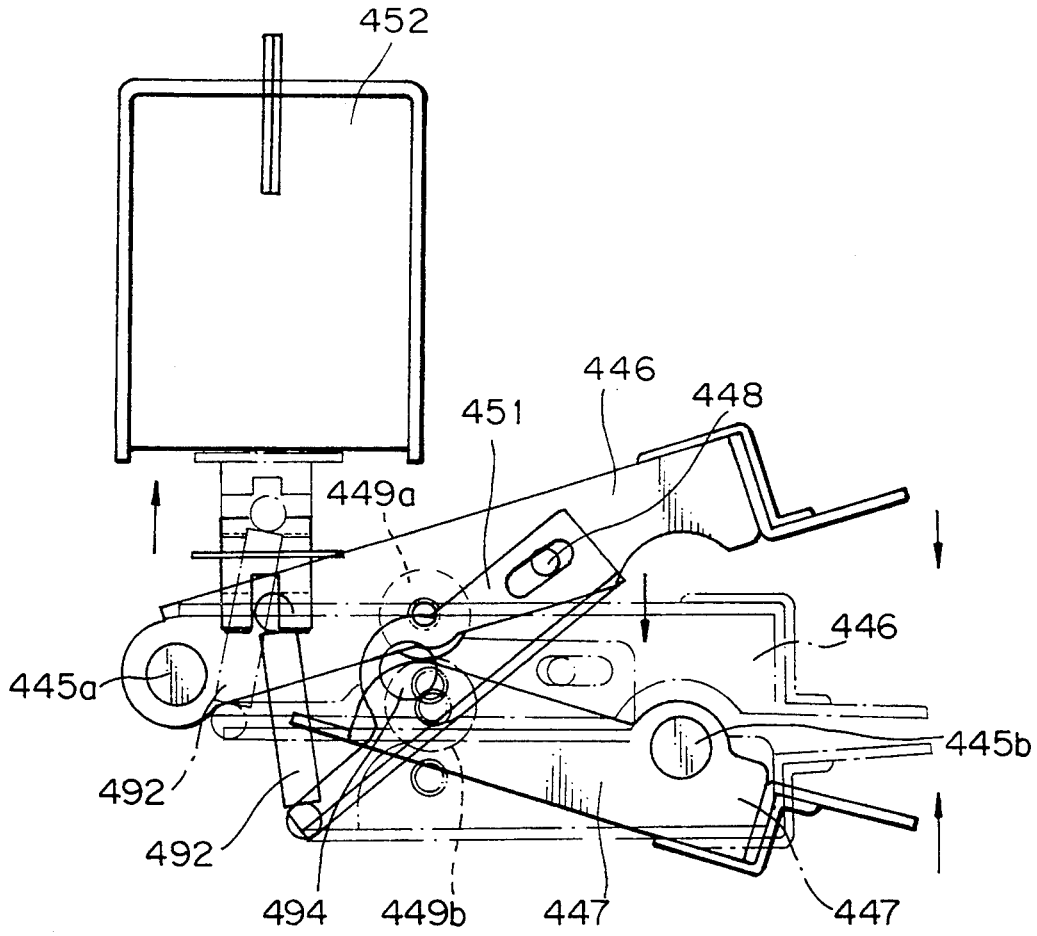
FIG. 8 demonstrates the chucking operation of the chuck.
Figure 9:
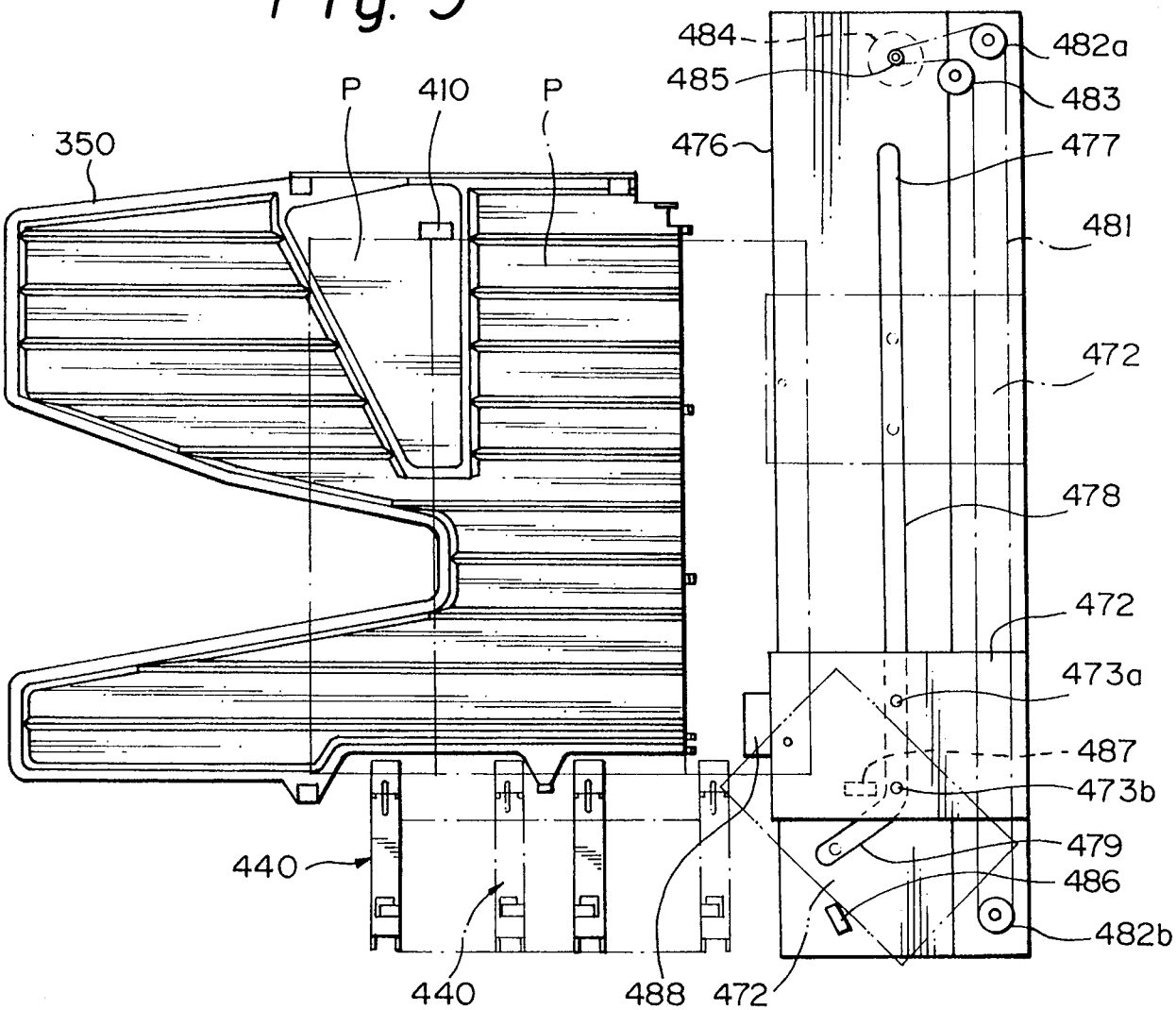
FIG. 9 is a plan view showing the second embodiment of the present invention.

Referring to FIGS. 1–8 of the drawings, a finisher embodying the present invention will be described. As shown in FIG. 1, the finisher includes a plurality of bins 350, and a jogger 410. Every time a paper P is driven out of an image forming apparatus, not shown, and stacked on any one of the bins 350, the jogger 410 jogs the paper P against a front side fence. As shown in FIG. 7, a chuck 440 has a front-rear solenoid 441, a tension spring 493, an arm 442 connected to the solenoid 441 by the spring 493, and a roller 443 mounted on the free end of the arm 442. When the solenoid 441 is energized, the arm 442 is rotated to cause the roller 443 to press an abutment 444*a* included in a front-rear movable portion 444. As a result, the movable portion 444 is moved forward to a position indicated by a dash-and-dot line in FIG. 7. As shown in FIGS. 4 and 8, the movable portion 444 includes two upper arms 446 and two lower arms 447 which are rotatable about shafts 445*a* and 445*b*, respectively. As shown in FIG. 3, the upper arms 446 are connected to each other by a shaft 448 so as to be movable at the same time.

Figure 5:
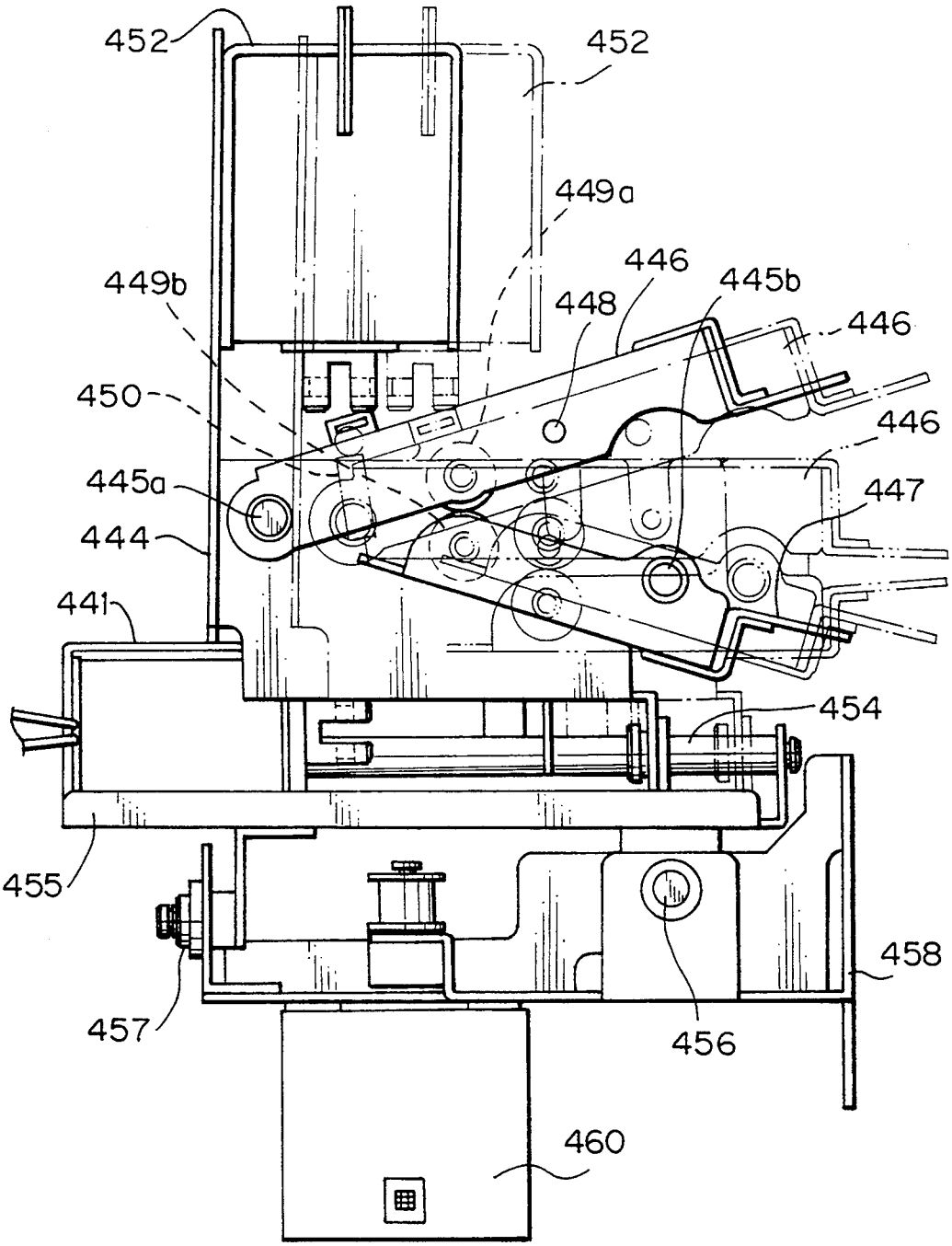
FIG. 5 is a view demonstrating the front-and-rear movement and chucking operation of the chuck.
Figure 6:
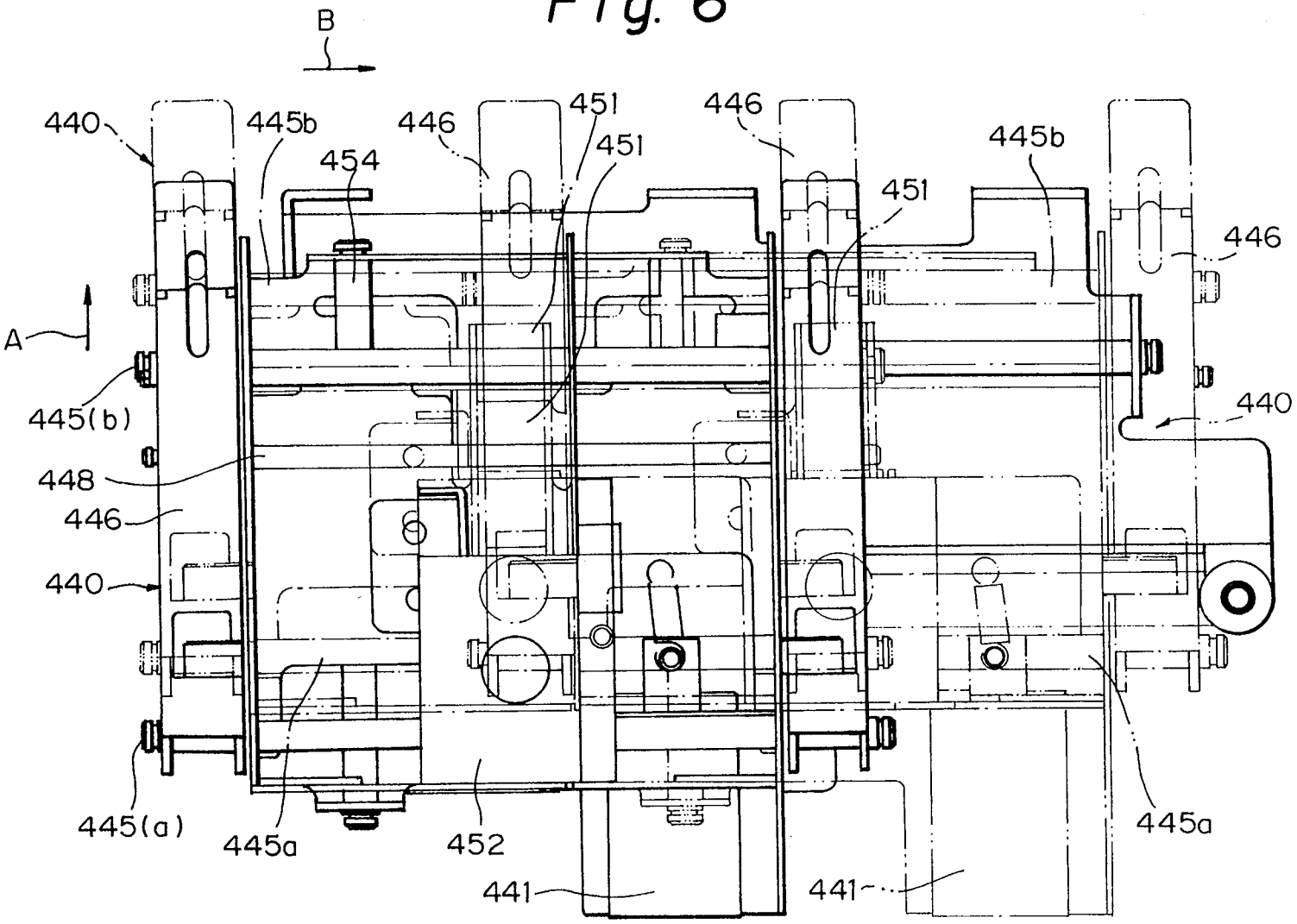
FIG. 6 is a view representative of the right-and-left movement of the chuck.

As shown in FIGS. 4, 5 and 8, each lower arm 447 contacts associated one of the upper arms 446 through slide rollers 449*a* and 449*b*. When the upper arms 446 are rotated downward, i.e., clockwise as viewed in the figures about the shaft 445*a*, the slide rollers 449*a* of the arms 446 urge the slide rollers 449*b* of the lower arms 447 downward. As a result, the lower arms 447 are rotated upward or counterclockwise about the shaft 445*b*. In this manner, the two pairs of upper and lower arms 446 and 447 are selectively opened or closed at the same time. A tension spring 450, FIG. 5, is associated with each of the lower arms 447. The tension spring 450 is anchored at one end to the lower arm 447 and at the other end to a lug 491*a* or 491*b*, FIG. 3, extending out from the movable portion 444. The springs 450 constantly bias the lower arms 447 in the clockwise direction, i.e., hold the upper and lower arms 446 and 447 in an open position.

As shown in FIG. 4, a lever 451 is rotatably supported by a shaft 494 and formed with an elongate slot 451*a* at one end thereof. The shaft 448 is received in the, slot 451*a*. The other end of the lever 451 is connected to an arm solenoid 452 by a tension spring 492. In this configuration, when the arm solenoid 452 is energized, each upper arm 446 is moved via the spring 492, lever 451 and shaft 448 and, in turn, moves the associated lower arm 447. The paper stack P has the edge thereof chucked by the arms 446 and 447 at two spaced points.

As shown in FIGS. 3 and 4, the front-rear movable portion 444 is slidably supported by guide shafts 454 which are provided on a right-left movable portion 455. This movable portion 455 is mounted on a stationary member 458 via a left-right guide shaft 456 and a guide roller 457 in such a manner as to be slidable in the direction perpendicular to the sliding direction of the movable portion 444. A home sensor, not shown, is provided on the stationary member 458. As the front-rear movable portion 444 in forward movement is sensed by the home sensor, it is brought to a stop, and then the arm solenoid 452 is energized to close the upper and lower arms 446 and 447.

The upper and lower arms 446 and 447 chuck the paper stack P at such a position that the two pairs of arms 446 and 447 can surely hold the paper stack P even when the papers are of minimum allowable size. In addition,, the chucking position adjoins the leading end of papers of minimum size with respect to the intended direction of paper discharge.

As shown in FIG. 1, a binding device, or binder, 470 comprises a stapler unit 471. As shown in FIG. 2, the stapler unit 471 is affixed to a movable portion 472. Two guide shafts 473*a* and 473*b* and three movable rollers are mounted on the movable portion 472. Two guide rollers are respectively supported by the guide shafts 473*a* and 473*b*. A stay member 476 is formed with a guide slot 477. The guide rollers of the guide shafts 473*a* and 473*b* are received in the guide slot 477. The guide slot 477 is made up of a parallel portion 478 parallel to the longitudinal direction of the stay member 476, and an inclined portion 479 extending from the parallel portion 478 at an angle of about 60 degrees. The parallel portion 478 and inclined portion 479 merge into each other along a smooth curve. In this configuration, the movable portion 472 moves along the parallel portion 478 parallel to, the stay member 476 and moves along the inclined portion 479 angularly, i.e., rotates with the guide shaft 473*b* received therein.

The stay member 476 extends in parallel to the rear edge of the bin 350 and, therefore, allows the movable member 472 to move in parallel to the rear edge of the paper stack P and to rotate in the vicinity of the front end of the paper stack P. A pulley 485 is mounted on the output shaft of a reversible drive motor 484. The movable member 472 is connected to the pulley 485 by a belt affixing member, a timing belt 481, pulleys 482*a* and 482*b*, and an idler 483. As the motor 484 is reversibly driven, it causes the movable portion 472 to move on and along the stay member 476 while carrying the stapler unit 471 therewith.

Home sensors 486 and 487 are mounted on the stay member 476. When the movable portion 472 is sensed by the sensor 486 or 487, the position of the stapler unit 471 is determined. Specifically, when the home sensor 486 senses the movable portion 472, the stapler unit 471 assumes a position inclining 45 degrees relative to the paper discharge direction. At this position, the stapler unit 471 drives a staple obliquely into the rear corner of the paper stack P, as indicated by a dash-and-dots line in FIG. 2. On the other hand, when the home sensor 487 senses the movable portion 472, the stapler unit 471 drives a staple into a position indicated by a dash-and-dot line or a solid line in FIG. 2 (parallel to the rear corner or to two points of the rear edge). When the drive motor 484 is controlled by pulses with the home sensor 487 used as a reference, the movable portion 472 is moved in parallel to the rear edge of the paper stack P so as to bind it at a particular position. By so controlling the motor 484 by pulses, it is possible to bind the rear edge of the paper stack P at a plurality of points.

In operation, as shown in FIG. 2, the papers P are each neatly positioned on the bin 350 by the jogger 410 every time it is driven out onto the bin 350, as stated earlier. As shown in FIG. 7, after all the expected papers P have been positioned on the bin 350 by the jogger 410, the front-rear solenoid 441 of the chuck 440 is energized to rotate the arm 442 connected to the solenoid 441. Then, the roller 443 mounted on the tip of the arm 442 urges the abutment 444*a* of the front-rear movable member 444 until the movable portion. 444 advances to a position indicated by dash-and-dot lines in FIGS. 5, 6 and 7. As shown in FIGS. 2 and 5, when the movable member 444 is moved along the guide shafts 454 to a predetermined position and stopped there, the arm solenoid 452 is energized to pull the tension spring 492, FIG. 4. As a result, the pulling force of the solenoid 452 overcomes the tension of the spring 450. Hence, the upper arms 446 are rotated clockwise about the shaft 445*a* via the spring 492 and levers 451. Then, the slide rollers 449*a* mounted on the upper arms 446 force the slide rollers 449*b* of the lower arms 447 downward. Consequently, the lower arms 447 are rotated counterclockwise about the shaft 445*b*. In this manner, the two pairs of upper and lower arms 446 and 447 are closed at the same time (dash-and-dots line position in FIG. 5 or dash-and-dot line position in FIG. 8). The arms 446 and 447, therefore, chuck the edge of the paper stack P at two spaced points. Further, the lower arms 447 are rotated by the force of the tension spring 450. As a result, the arms 446 and 447 are urged in the opening direction and held in the open position. At this instant, the front-rear movable member 444 is located at a home position thereof defined on the stationary member 458.

After the upper and lower arms 446 and 447 have chucked the paper stack P, a drive motor 460 is energized to move the right-left movable portion 455 in the direction opposite to the paper discharge direction (direction B in FIGS. 2 and 6) via a timing belt 459. Simultaneously, the arms 446 and 447 are moved in the same direction as the movable portion 455 while chucking the paper stack P. As the movable portion 455 reaches a predetermined position (dash-and-dots line in FIG. 6), the stapler unit 471 of the binder 470 is operated to drive a staple into the paper stack P.

After the binding operation, the motor 460 is again driven to cause the right-left movable portion to move in the paper discharge direction (opposite to direction B) together with the paper stack P. As the movable portion 455 is moved over the home sensor position, it is brought to a stop, and then the arm solenoid 452 is deenergized. As a result, the tension biasing the levers 451 counterclockwise is reduced, and in turn the force of the tension spring 450 increases relative to such a tension. Consequently, the lower arms 447 are urged by the spring 450, i.e., the arms 446 and 447 are opened (dash-and-dot line position in FIG. 5). Consequently, the paper stack P is returned to the bin 350. Subsequently, the front-rear solenoid 441 is energized to return the front-rear movable portion 444 from the dash-and-dot line position of FIG. 6 to the initial position (solid line position in FIG. 6) in a direction opposite to a direction A. The sequence of steps described above is performed with all of the bins 350 on which paper stacks P are present.

The embodiment described above, has the following advantages. The chuck 440 has two pairs of chucking members and, therefore, chucks the paper stack P at two spaced points. This prevents the paper stack P from rotating due to gravity. Hence, even when the paper stack P is moved in the paper discharge direction, it can be brought to the binder 470 in a stable manner and bound thereby accurately.

Figure 10:
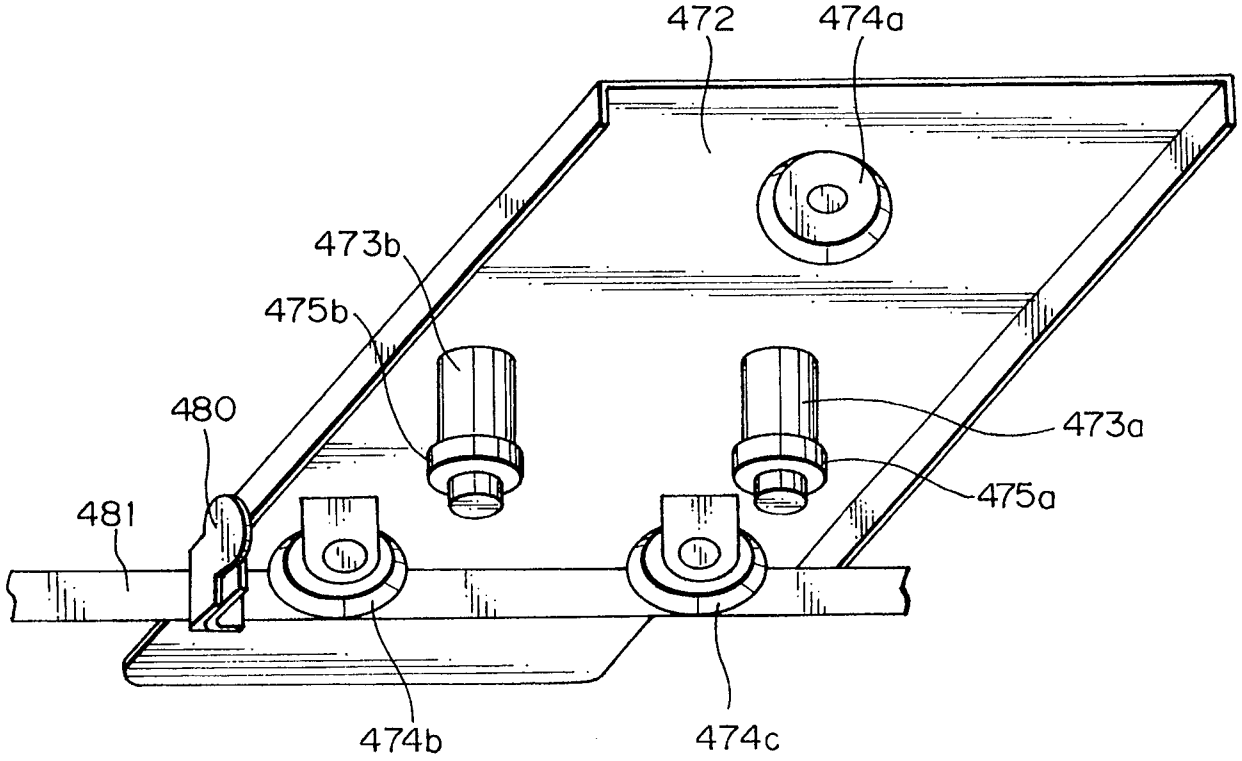
FIG. 10 is a perspective view of the second embodiment.

Referring to FIGS. 1 and 9–11, an alternative embodiment of the present invention is shown. In this embodiment, the same or similar constituent parts as or to the parts of the previous embodiment are designated by the same reference numerals. As shown, the papers P sequentially stacked on the bin 350 are positioned by the jogger 410, chucked by the chuck 440, and then brought to the binder 470. The binder 470 has the movable portion 472 to which the stapler unit 471 is affixed. As shown in FIG. 10, three rollers 474*a*, 474*b* and 474*c* are mounted on the movable portion 472 together with the two guide shafts 473*a* and 473*b*. Guide rollers 475*a* and 475*b* are rollably mounted on the guide shafts 473*a* and 473*b*, respectively. The guide rollers 475*a* and 475*b* are received in the guide slot 477 of the stay member 476. The guide slot 477 is made up of a parallel portion 478 parallel to the longitudinal direction of the stay member 476, and an inclined portion 479 extending from the parallel portion 478 at an angle of about 60 degrees. The parallel portion 478 and inclined portion 479 merge into each other along a smooth curve. In this configuration, the movable portion 472 is movable along the parallel portion 478 parallel to the stay member 476 and rotates along the inclined portion 479 with the guide shaft 473*b* received therein.

The stay member 476 extends in parallel to the rear edge of the bin 350 and, therefore, allows the movable member 472 to move in parallel to the rear edge of the paper stack P and to rotate in the vicinity of the front end of the paper stack P. The pulley 485 is mounted on the output shaft of the reversible drive motor 484. The movable member 472 is connected to the pulley 485 by a belt affixing member 480 and the timing belt 481, pulleys 482*a* and 482*b*, and idler 483. As the motor 484 is reversibly driven, it causes the movable portion 472 to move on and along the stay member 476 while carrying the stapler unit 471 therewith.

Figure 11A:
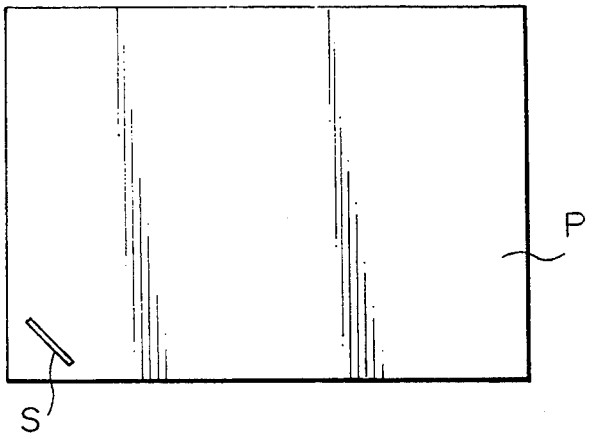
FIGS. 11A–11C are views showing specific binding positions available with the present invention.
Figure 11B:
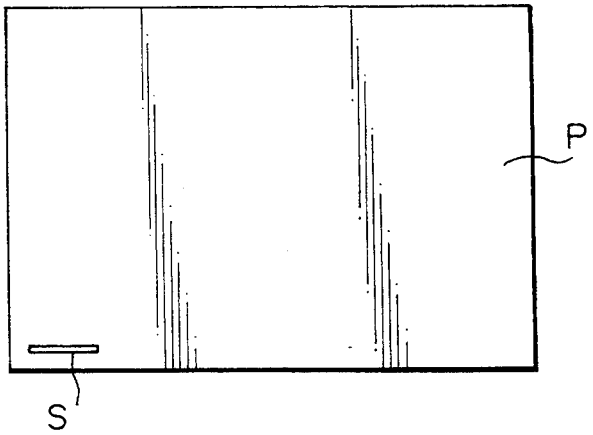

The home sensors 486 and 487 are mounted on the stay member 476. When the movable portion 472 is sensed by the sensor 486 or 487, the position of the stapler unit 471 is determined. Specifically, when the home sensor 486 senses the movable portion 472 (dash-and-dots line in FIG. 9), the stapler unit 471 assumes a position inclined 45 degrees relative to the paper discharge direction. At this position, the stapler unit 471 drives a staple S obliquely into the rear corner of the paper stack P, as shown in FIG. 11A. On the other hand, when the home sensor 487 senses the movable portion 472 (solid line position in FIG. 9), the stapler unit 471 drives a staple S into the paper stack P in parallel to the rear corner, as shown in FIG. 11B. When the drive motor 484 is controlled by pulses with the parallel home sensor 487 used as a reference, the movable portion 472 is moved in parallel to the rear edge of the paper stack P so as to bind it at a particular position (e.g. dash-and-dot line position in FIG. 9). Then, the stapler unit 471 drives staples at points shown in FIG. 11C (two spaced points at the rear edge). By so controlling the motor 484 by pulses, it is possible to staple the rear edge of the paper stack P at a plurality of points.

The operation of the alternative embodiment is as follows. As the chuck 440 chucks the paper stack P and brings it to the binder 470, a paper sensor 488 provided on the stapler unit 471 senses it. Then, the stapler unit 471 is moved to a particular position to staple the paper stack P. Subsequently, the chuck 440 returns the paper stack P to the bin 350, and then the bin 350 is shifted upward or downward. In this condition, the chuck 440 chucks the next paper stack P and brings it to the binder 470. Such a procedure is repeated thereafter until all the paper stacks P present on the bins 350 have been bound.

Figure 11C:
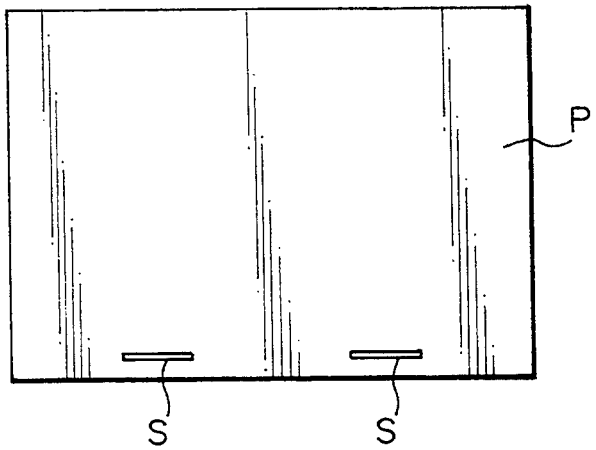

How to bind the paper stack P at the positions shown in FIGS. 11A–11C will be described specifically. To drive the staple S obliquely into the rear corner of the paper stack S, as shown in FIG. 11A, the movable portion 472 is moved along the parallel portion 478 of the guide slot 477 which merges into the inclined portion 479. As the guide shaft 473*b* of the movable portion 472 moves along the inclined portion 479, the movable portion 472 is bodily rotated to reach the dash-and-dots line position shown in FIG. 9. When the movable portion 472 is sensed by the home sensor 486, the stapler unit 471 is inclined 45 degrees relative to the paper discharge direction and staples the paper stack P in such a position. To drive the staple S in parallel to the rear corner of the paper stack P, as shown in FIG. 11B, the movable portion 472 is moved until it has been sensed by the home sensor 487 (solid line in FIG. 9). Further, to drive two staples S into the rear edge of the paper stack P, the drive motor 484 is controlled by pulses with the home sensor 487 used as a reference. Specifically, the movable portion 472 is sequentially moved to and stopped at particular spaced positions along the rear edge of the paper stack P.

As stated above, the alternative embodiment allows the binder 470 to move in parallel to the rear edge of the paper stack P and to rotate at the front corner of the paper stack P. Hence, the paper stack P can be bound by the binder 470 in any one of a plurality of different manners. Since the parallel movement and rotation of the binder 470 are implemented by a single drive motor 484, the binder 470 is simple and inexpensive. In addition, the single drive source simplifies the control. Since the drive motor 484 is located at a different position from the movable portion 472, it is not necessary to mount a drive source on the movable portion 472. This is successful in providing the movable portion 472 with a simple and miniature configuration, while reducing the space which the portion 472 moves. Moreover, the rotation and parallel movement of the binder 470 are controlled on the basis of the pulse control of the stepping motor 484, the binder 470 can start and stop moving at any position within the movable range thereof. This allows the binder 470 to bind the paper stack P at any desired position, i.e., makes it possible to change the binding position and the number of times of binding depending on the paper size. As a result, the finisher is operable far more freely than conventional finishers.

In summary, it will be seen that the present invention provides a finisher having various unprecedented advantages, as enumerated below.

(1) A chuck has two pairs of chucking members and, therefore, chucks a paper stack at two spaced points. This prevents the paper stack from rotating due to gravity. Hence, even when the paper stack is moved in a paper discharge direction, it can be brought to a binder in a stable manner and bound thereby accurately.

(2) Since a paper stack of any size is brought to the binder stably with no regard to the paper size, accurate binding is enhanced.

(3) The binder is capable of moving in parallel to the rear edge of a paper stack and to rotate at the front corner of the paper stack. Hence, the paper stack can be bound by the binder in any one of a plurality of different manners.

(4) Since the parallel movement and rotation of the binder are implemented by a single drive source, the binder is simple and inexpensive. In addition, the single drive source simplifies the control.

(5) Since the drive source is located at a different position from a movable portion, it is not necessary to mount a drive source on the movable portion. This is successful in providing the movable portion with a simple and small size configuration, while reducing the space which the movable portion moves.

(6) The rotation and parallel movement of the binder are controlled on the basis of the pulse control of a stepping motor. Hence, the binder can start and stop moving at any position within the movable range thereof. This allows the binder to bind a paper stack at any desired position, i.e., makes it possible to change the binding position and the number of times of binding depending on the paper size. As a result, the finisher is operable far more freely than conventional ones.

Various modifications will become possible for those skilled in the art after receiving the teachings of the present disclosure without departing from the scope thereof.

What is claimed is:

1. A finisher for an image forming apparatus, comprising:

a distributing means for distributing papers sequentially driven out of said image forming apparatus;

a positioning means for positioning the papers distributed;

a binding means for binding the papers distributed and positioned in a stack; and a chucking means comprising a first pair of upper and lower chucking members and a second pair of upper and lower chucking members, said first and second pairs of chucking members being spaced a predetermined distance from each other in an intended direction of paper discharge, said chucking means chucking the stack of papers and moving said stack to said binding means;

wherein:

the upper chucking members of said first and second pairs of chucking members are connected to each other by a shaft such that the upper chucking members of said first and second pairs of chucking members are movable together; and movement of the upper chucking members of said first and second pairs of chucking members towards the lower chucking members of said first and second pairs of chucking members causes a movement of the lower chucking members in a direction toward said upper chucking members so as to chuck said stack of papers at two spaced points.

2. A finisher as claimed in claim 1, wherein said first and second pairs of chucking members adjoin a leading edge of papers of minimum size with respect to said intended direction of paper discharge and chuck said papers of minimum size at two spaced points.

3. A finisher for an image forming apparatus, comprising:

a distributing means for distributing papers sequentially driven out of said image forming apparatus to a plurality of bins;

a positioning means for positioning the papers distributed to said plurality of bins;

a binding means movable along and in parallel to a rear edge of any one of said plurality of bins, and rotatable at a front side of the bin contiguous with said rear edge; and drive means for moving said binding means in parallel to the rear edge of any one of said plurality of bins and in rotation at the front side of the bin contiguous with said rear edge, said drive means being located at a different position from a movable portion included in said binding means.

4. A finisher as claimed in claim 3, wherein said drive means is a single drive means, and said binding means moves along a single slot.

5. A finisher as claimed in claim 3, wherein said drive means comprises a stepping motor controlled by pulses for causing said binding means to stop at a desired position.

* * * * *